United States Patent [19]

Bullock et al.

[11] Patent Number: 4,798,301

[45] Date of Patent: Jan. 17, 1989

[54] TAMPER-RESISTANT CAP FOR WIDE MOUTH JAR

[75] Inventors: Joseph J. Bullock, Atherton; Wayne L. Hatch, Gilroy; George Tackles, San Jose, all of Calif.

[73] Assignee: Cap Snap Co., San Jose, Calif.

[21] Appl. No.: 132,793

[22] Filed: Dec. 14, 1987

[51] Int. Cl.[4] ..... B65D 41/48

[52] U.S. Cl. ..... 215/256; 220/270

[58] Field of Search ..... 215/256; 220/270

[56] References Cited

U.S. PATENT DOCUMENTS

| | | | |
|---|---|---|---|
| 3,979,003 | 9/1976 | Allen | 215/256 |
| 4,066,181 | 1/1978 | Robinson et al. | 215/256 |
| 4,281,774 | 8/1981 | Mumford | 215/256 X |
| 4,593,830 | 6/1986 | Bullock | 215/256 |
| 4,625,876 | 12/1986 | Bullock | 215/256 |
| 4,691,834 | 9/1987 | Bullock | 215/256 |

FOREIGN PATENT DOCUMENTS

| | | | |
|---|---|---|---|
| 222526 | 7/1962 | Austria | 215/256 |

*Primary Examiner*—Donald F. Norton

*Attorney, Agent, or Firm*—Julian Caplan

[57] ABSTRACT

A cap of a type having a top disk with depending outer and inner skirts between which the neck of the jar fits is disclosed. The inner surface of the outer skirt and the outside of the neck have cooperating upper and lower locking beads holding the cap in place until the lower portion of the skirt is torn off by tearing along a horizontal score line and thereby removing the lower cap locking bead. The skirt is torn by pulling a tab horizontally. The tab in one form of the invention is defined by cutouts in the lower portion of the outer skirt and is offset outwardly for easy engagement by the finger of the user. In a modification there are two tabs extending in opposite directions, either of which may be pulled to tear off the lower skirt and both tabs being joined by narrow links to a central release lug. The latter is bent upward, thereby breaking the links. The lug has an additional utility in prying off the cap from the neck of the jar after the lower skirt is torn off. An alternative means for lifting the cap off the neck is the fact that the exterior of the outer skirt slants upward-outward above the level of the horizontal score line and hence is conveniently gripped by the user. A further feature of the invention is that the lower end of the inner skirt or plug curves downward-inward, facilitating seating the cap on the neck.

11 Claims, 2 Drawing Sheets

TAMPER-RESISTANT CAP FOR WIDE MOUTH JAR

CROSS REFERENCES TO RELATED APPLICATIONS

This invention is an improvement upon U.S. Pat. Nos. 4,625,876 and 4,691,834.

BACKGROUND OF THE INVENTION

1. Field of the Invention

This invention relates to a new and improved tamper-evident cap for wide mouth jars. More particularly the invention relates to features of the cap including the tear tabs which are used to tear off the lower portion of the skirt, to the shape of the exterior of the skirt which facilitates removing the cap from the jar and to the formation of the inner skirt or plug with an inwardly-downwardly curved lower edge which facilitates seating the cap on the jar neck.

2. Description of Related Art

The present invention is an improvement upon prior jars of the assignee of this invention such as U.S. Pat. Nos. 4,625,876 and 4,691,834. The present invention has important advantages over the prior art as set forth in the preceding paragraph of the specification.

SUMMARY OF THE INVENTION

This invention relates to a new and improved tamper-evident cap and to the combination of such a cap and a wide mouth jar. In this cap, to remove the lower portion of the skirt and thereby remove the lower locking bead which engages the jar neck and holds the cap in position, one forces a tear tab outwardly thereby severing the link which connects the tear tab to the remainder of the outer skirt. To facilitate this operation, the tear tab is displaced outwardly relative to the remainder of the outer skirt. The skirt is scored immediately above the level of the tear tab and hence by pulling the tear tab horizontally around the periphery of the jar the lower portion of the skirt is torn away. Arrows on the tear tab indicate the necessary direction of tearing and also facilitate the user gripping the tab. After the lower part of the skirt is torn away, only one set of beads on the cap engages the jar neck and hence the upper part of the cap may be removed. To facilitate such removal, the exterior of the upper portion of the skirt slants outwardly-upwardly. To facilitate seating and reseating of the cap on the jar neck, the inner skirt or plug of the cap is thin and also curves downwardly-inwardly. In a modification of the invention, there are two tabs extending in opposite directions and the user may pull either tab. Frangible links connect the ends of the two tabs to a central lug. By prying the lug upward, the links may be broken. After the bottom portion of the skirt is torn away, the lug may be used to pry the upper part of the cap off the neck.

Other objects of the present invention will become apparent upon reading the following specification and referring to the accompanying drawings in which similar characters of reference represent corresponding parts in each of the several views.

BRIEF DESCRIPTION OF THE DRAWINGS

In the accompanying drawings, similar reference numerals refer to corresponding parts.

DESCRIPTION OF PREFERRED EMBODIMENTS

Figure 1:
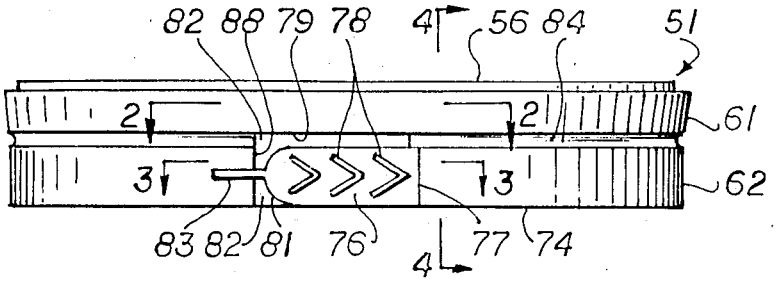
FIG. 1 is a side elevation of one form of cap in accordance with the present invention.

Neck 11 of the container is preferably formed of blow-molded polyethylene or similar plastic material. The shape of the neck shown herein is not novel and it will be understood that details of the shape may be varied so long as a secure fit is made with the cap hereinafter described. In the form of the neck 11 best shown in FIG. 4, there is a top flange 12 shown flat (but which may be upward-inward slanted) having an inner edge 13 which, in the assembled condition of the cap and neck is preferably vertical. Below edge 13 the neck has a horizontal outward stretch 14 leading to an internal upper groove 16. Thereupon the interior of the neck extends in a first downward-inward slanted stretch 17 which terminates in a curved contact edge 18.

Below edge 18 is a downward-outward slant stretch 19 leading to a second internal groove 21. Below groove 21 there is a second downward-inward slanted stretch 22 terminating in a second curved edge 23.. Below edge 23 is a downward-outward slanted edge 24.

Directing attention now to the exterior of the neck 11, flange 12 has a top surface 34 here shown as horizontal and there is a rounded corner 36 at the outer edge of surface 34 which merges into a first or upper curved stretch 37. Below surface 37 is a first shoulder 38 here shown as being an inward slanted surface. Surface 38 terminates in top groove 39. The surfaces 36, 37 and 38 define the shape of top neck bead 41. Below groove 39 is a downward-outward slanted stretch 42 which terminates in a second curved stretch 43 extending inward. Shoulder 44 is formed under the curved stretch 43 and below and inward of shoulder 44 is second external groove 46. Below groove 46 the exterior of neck 11 slants downward outward in a stretch 47.

Directing attention now to cap 51, the cap preferably has a substantially horizontal top disc 52 and on the periphery of disc 52 there depends outer skirt 53 and spaced inward of skirt 53 is an inner skirt or plug 54. On the top surface of disc 52 is a stacking ring 56 having a slanted inner surface 57, a top horizontal surface 58 and an outer vertical edge 59. Ring 56 is shown in the referenced U.S. Pat. No. 4,625,876 and application Ser. No. 858,811, filed May 2, 1986, now U.S. Pat. No. 4,691,834, dated Sept. 8, 1987. It is useful in stacking the caps 51 for transportation. It has a further function of rigidifying the top disc 52 so that as the cap cools after it has been molded the shape of the cap is maintained.

It will be understood that the underside 60 of disc 52 engages the surface 34 of flange 12 when the cap is seated on the neck.

Directing attention now to the outer skirt 53 and more specifically to the exterior thereof, the upper end 61 of the skirt slants downward inward preferably at an angle of approximately eight degrees. Below skirt section 61 is the lower skirt outer wall 62 which is preferably vertical When the lower portion 62 is torn away, as hereinafter explained, the slanted upper portion 61 may be gripped by the user and it facilitates pulling the upper part of the cap off the neck 11. It will be understood that various other means may be used to facilitate removal of the cap after the lower skirt portion has been removed.

Figure 5:
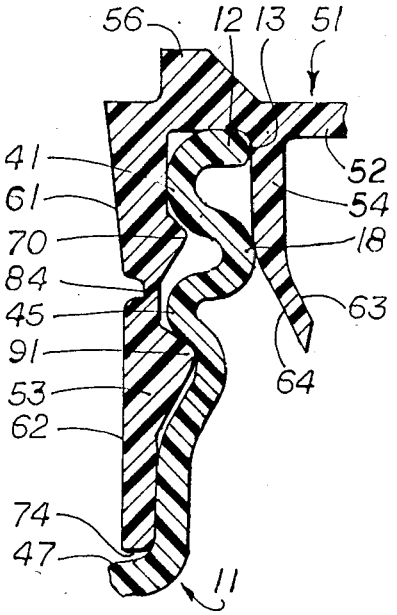
FIG. 5 is a view similar to FIG. 4 showing the cap seated on the neck.

Directing attention now to inner skirt or plug 54, it should be understood that the wall of 54 is made thinner than in previous caps of this general type and that the lower end 63 of plug 54 curves inwardly so that the surface 64 slants from the vertical at an angle of approximately 30 degrees. The slant of the surface 64 facilitates the cap 51 seating on the neck 11. The spacing between the skits 53 and 54 is such that a tight contact of the flange 12 with the underside 60 of the disc 52 and of the surface 13 with the outer wall of skirt 54 and the surface 18 with the lower portion of the outer wall of skirt 54 is attained, all as seen in FIG. 5.

Directing attention now to the inside of outer skirt 53, below surface 60 there is a depending substantially vertical inner top wall 66 which terminates in a downward-inward slanted surface 67 disposed at an angle of about 30 degrees with respect to the horizontal and giving way to an outward-downward slanted surface 68 disposed at an angle of about 55 degrees to the horizontal. The surfaces 67 and 68 define top bead 70 which is so located as to seat under the surface 38 to maintain the cap 51 seated on the neck 11 even when the lower portion of the skirt is torn away but in such a manner that by prying the cap upward it may be pulled off of the neck 11. Below surface 68 is a lower inner wall 69 which also is substantially vertical and this terminates in a downward-inward slanted surface 71 which in turn gives way to a downward-outward slanted surface 72. The surfaces 71 and 72 are disposed at 30 degrees and 55 degrees from the horizontal respectively. Surfaces 71 and 72 define the lower locking bead 91 which is so located at to seat under the surface 44 as best shown in FIG. 5. When the beads 70 and 91 are both in contact with the neck and seated under the shoulders 38 and 44, the cap cannot be pried off the neck 11 without distorting the neck 11. The only way that the cap may be removed is by tearing off the lower end of the skirt, which provides evidence of tampering with the contents of the container.

Upper bead 70 is preferably interrupted in a plurality of short rounded bead sections 86 separated by gaps 87. The lower bead 91 can be substantially continuous around the interior of the lower skirt 62 or it may be interrupted in a plurality of bead sections as is best shown in U.S. Pat. No. 4,625,876. Below surface 72 is a substantially vertical surface 73 terminating in bottom edge 74.

Figure 3:
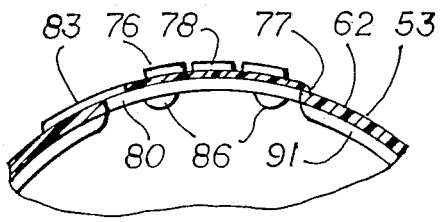
FIG. 3 is an enlarged fragmentary sectional view taken substantially along the line 3—3 of FIG. 1.
Figure 2:
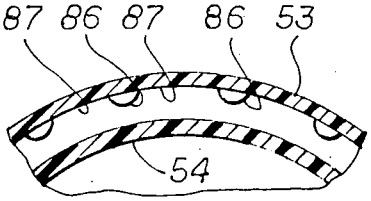
FIG. 2 is an enlarged fragmentary sectional view taken substantially along the line 2—2 of FIG. 1.

Directing attention now to FIGS. 1 and 3, a tear tab 76 is defined in lower skirt section 62. It will be seen that the tear tab 76 is outwardly offset relative to the skirt portion 62 so that there is a space 80 which facilitates the fingernail of the user gripping the tab 76. One feature of the tab 76 shown in FIG. 1 is the formation on the outer surface thereof of embossed arrows 78 which indicate the direction in which the tab 76 should be torn and also provide gripping ridges which facilitate the user grasping the tab 76. Tab 76 is preferably formed by a horizontal slit it in the skirt section 62 immediately above tab 76 and is further defined by a semi-circular curved edge 81. There are cutouts 82 in skirt 53 at the corners so that there is a relatively vertical edge 88 opposite the rounded end of the tab 76. A link 83 is attached to the left end of tab 76 as viewed in FIG. 1 and joins the skirt portion 62 somewhat to the left of the edge 88. Link 83 is fragile and may be easily broken by the user when preparing to tear off the cap. However, the presence of the link 83 ensures that the tab 76 will not be bent outward unintentionally. There is a horizontal score line 84 extending as an extension of slit 79 circumferentially around the skirt 53. Line 84 is here shown to be on the exterior of skirt 53, but could be formed on the interior.

Figure 4:
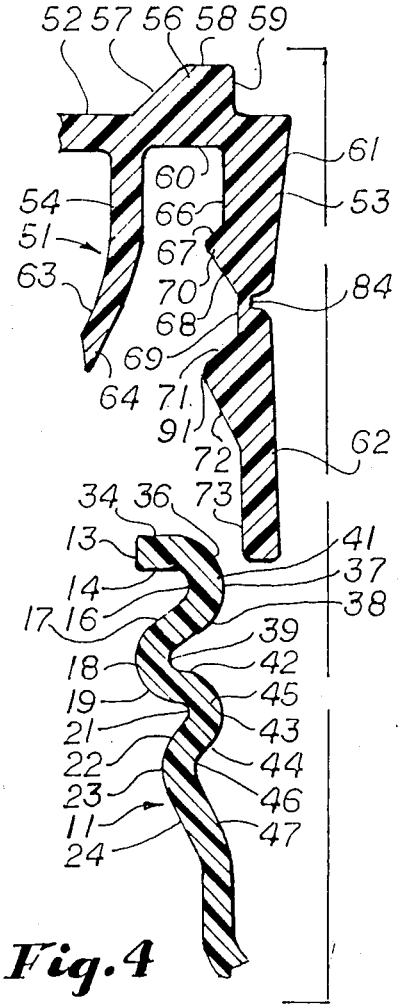
FIG. 4 is an exploded greatly enlarged sectional view taken substantially along the line 4—4 of FIG. 1.

In use, in order initially to seat cap 51 on the neck 11, the cap 51 is forced downward from the position of FIG. 4 to the position of FIG. 5. By reason of the flexibility of the inner skirt 54 and the inward curve of surface 64, seating of the cap is facilitated. Thus, the inner skirt of the plug has less material and is more flexible than prior plugs. When the cap 51 is fully seated on neck 11, the bead 70 locks under the bead 41 and the bead 91 locks under the bead 45. As is apparent from FIG. 5, the contents of the container are sealed against leaking. The cap 51 may not be pulled off the neck 11 so long as the skirt is intact because the seating of the beads as heretofore described in so secure that the neck 11 must be crushed before the cap can be pulled away.

When it is desired to open the container, the user breaks the link 83 and inserts a finger or fingernail into the gap 80 pulling the tab 76 outward and grasping the ridges 78. The ridges 78 indicate to the user the direction in which the tab 76 should be torn. Pulling the tab 76 causes the skirt 53 to tear off along the horizontal score line 84 thereby removing the lower bead 91. Thereupon the user may grip the skirt surface 61 and pull the upper portion of the cap (termed a reclosure cap) up, causing the bead 70 to disengage from the bead 41. The reclosure cap may be reapplied and the container may be opened and reclosed until its contents are exhausted.

Figure 6:
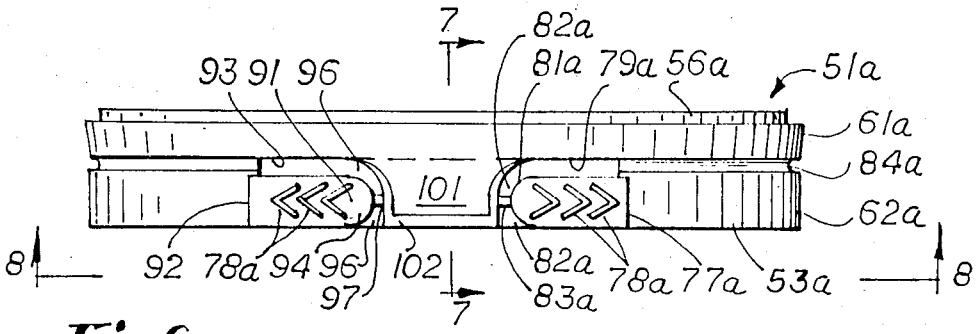
FIG. 6 is a view similar to FIG. 1 of a modification.
Figure 8:
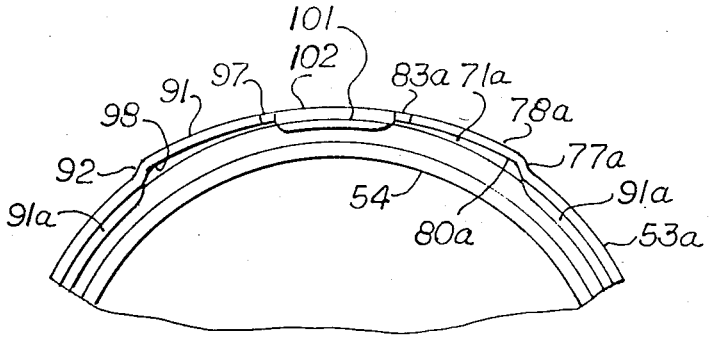
FIG. 8 is an enlarged fragmentary bottom plan view as viewed substantially along the line 8—8 of FIG. 6.
Figure 7:
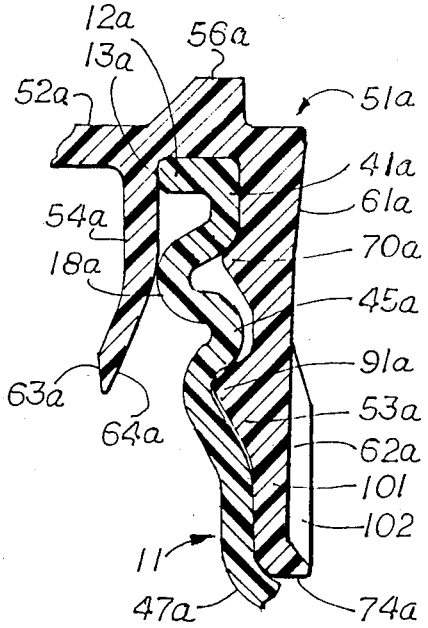
FIG. 7 is an enlarged sectional view taken substantially along the line 7—7 of a cap seated on a jar neck.

Directing attention now to the modification shown in FIGS. 6–8, it will be seen that there are two tear tabs **76*a* and 91, directed in opposite directions. Tab is spaced outward in an offset 92 so that there is a space 98 similar to the space 80*a* into which the finger or fingernail of the user may be inserted in order to pull the second tear tab 91 away. Tab 91 is defined by a horizontal slit 93 which is at the same elevation as the sit 79*a* and the horizontal score line 84*a*. The inner end of the tabs 91 is defined by semi-circular curved edge 94 and there are cutouts 96 similar to the cutouts 82*a* of the right hand tab. Similarly there is a link 97 which joins the end of the tab 91 to a lug 101 which depends below upper skirt section 61*a*. It will also be seen that link 83*a* joins the inner end of the right hand tear tab 76*a* to the depending lug 101. Lug 101 is reinforced by a rim 102 which is disposed along the bottom edge of lug 101** and the side edges thereof.

To use the modification of FIG. 6, the user inserts his finger under the lug 101 and bends it outward thereby breaking both links **83*a* and 97. The user may then grasp either the tear tab 76*a* or the tear tab 91, pulling in the direction of the arrows 78*a* and causing the lower portion of the skirt 53*a* to tear off along the horizontal score line 84*a*. Removal of the lower portion of the skirt permits the user to pry the lug 101 outward and thereby to pull the upper portion of the cap 51***a* off the neck 11.

In many respects the modification of FIGS. 6–8 resemble those of the preceding modification and the same reference numerals followed by the subscript a are used to designate corresponding parts.

What is claimed is:

1. A tamper-evident cap comprising a top disk, an outer skirt depending from said top disk having internal upper and lower locking bead means and a horizontal score line extending substantially circumferentially of said outer skirt intermediate said upper and lower bead means, said outer skirt being cut away adjacent its lower edge to form a horizontally elongated tear tab, said tear tab being radially outwardly offset relative to the outer circumference of a major portion of said outer skirt to provide a space inside said tear tab for insertion of a finger or fingernail to grasp said tear tab.

2. A cap according to claim 1 in which the upper edge of said tear tab is located immediately below the level of said score line.

3. A cap according to claim 1 in which the outer surface of said tear tab is embossed with a chevron pattern to indicate proper direction to pull said tear tab and also to afford gripping ridges t facilitate the user gripping s id tear tab.

4. A cap according to claim 1 which further comprises a frangible link connecting the end of said tear tab to a portion of said cap outside the perimeter of said tear tab.

5. A cap according to claim 1 in which said outer skirt is also cut away adjacent its lower edge to form a second horizontally elongated tear tab spaced from and extending in a direction opposite said first mentioned tear tab, and which further comprises a lug intermediate said tear tab extending downward from the portion of said outer skirt above said score line, said lug providing means to lift said cap when the lower end of said outer skirt has been torn off.

6. A cap according to claim 5 in which said second tear tab is offset relative to the outer circumference of a major portion of said outer skirt to provide a second space inside said second tear tab for insertion of a finger or fingernail to grasp said second tear tab.

7. A cap according to claim 5 which comprises a first frangible link connecting the outer end of said first mentioned tear tab to said lug and a second frangible link connecting the outer end of said second tear tab to said lug, whereby lifting said lug breaks said frangible links.

8. A cap according to claim 1 in which the upper end of the outside of said outer skirt slants outward-upward to provide means for lifting said cap when the lower end of said cap has been torn off.

9. A cap according to claim 1 in which the outside of said outer skirt slants upward-outward above said score line to provide means for lifting said cap when the lower end of said cap has been torn off.

10. A cap according to claim 9 in which the outside of said outer skirt is substantially vertical below said score line.

11. A cap according to claim 1 which further comprises an inner skirt depending from said disk spaced inward of said outer skirt and having inner and outer walls, said inner and outer walls of said inner skirt being formed curved inward in a large radius.

* * * * *